United States Patent [19]

Ito et al.

[11] 4,126,982

[45] Nov. 28, 1978

[54] APPARATUS FOR BINDING A STACK OF PAPER SHEETS

[75] Inventors: Yukio Ito, Fujisawa; Susumu Morishima, Kamakura, both of Japan

[73] Assignees: Hitachi Denshi Engineering Kabushiki Kaisha, Kanagawa; Musashi Kabushiki Kaisha, Tokyo, both of Japan

[21] Appl. No.: 789,274

[22] Filed: Apr. 20, 1977

[30] Foreign Application Priority Data

Apr. 27, 1976 [JP] Japan ..... 51-47208
Apr. 17, 1976 [JP] Japan ..... 51-47212

[51] Int. Cl.[2] ..... B65B 13/04; B65B 27/08
[52] U.S. Cl. ..... 53/593
[58] Field of Search ..... 53/124 C, 198 R, 199, 53/210, 218; 100/27, 28

[56] References Cited

U.S. PATENT DOCUMENTS

| | | | |
|---|---|---|---|
| 551,463 | 12/1895 | Crowell | 53/199 |
| 1,204,118 | 11/1916 | Batdorf | 53/198 R |
| 1,583,395 | 5/1926 | Davidson et al. | 53/199 |
| 3,003,297 | 10/1961 | Broadhead et al. | 100/27 X |
| 3,207,060 | 9/1965 | Smith | 53/198 R |
| 3,327,453 | 6/1967 | Willbrandt et al. | 53/228 |
| 3,955,340 | 5/1976 | Tomita et al. | 53/199 |
| 4,014,731 | 3/1977 | Muto | 53/198 R X |

FOREIGN PATENT DOCUMENTS

| | | | |
|---|---|---|---|
| 2,432,679 | 1/1975 | Fed. Rep. of Germany | 53/228 |

*Primary Examiner*—John Sipos
*Attorney, Agent, or Firm*—Wenderoth, Lind & Ponack

[57] ABSTRACT

Disclosed is an apparatus for binding a stack of paper sheets such as paper money with a binding tape or band. The winding of the binder tape around the paper stack is effected after the leading end portion of the binder tape has been securely inserted into the paper stack.

For inserting the leading end portion of the tape into the paper stack, a gap for receiving the tape leading end is formed by a divider or splitter means comprising a reciprocably movable plate formed with a knife edge which is movable toward the paper stack and which can penetrate into the stack, to thereby form the gap as the paper stack is fed toward a predetermined winding position, at which position the paper stack is supported on a stationary platform having an upper surface formed with an arcuate recess.

5 Claims, 4 Drawing Figures

APPARATUS FOR BINDING A STACK OF PAPER SHEETS

BACKGROUND OF THE INVENTION

The present invention relates to an apparatus for binding a bundle or stack of paper sheets such as paper money by a binder tape or band.

In some industrial fields, it is practiced that a plurality of stacked paper sheets are bound by winding a binder tape therearound. For example, it is known that a predetermined number of sheets of paper money are bundled in this manner. In this connection, with a view to obtaining a positively and securely wound bundle of the stacked paper sheets to thereby prevent the wound stack from becoming loosened, one end of the binder tape is inserted into the paper stack and the tape is wound around the stack in a desired number of turns. After the paper stack has thus been wound, the tape is cut and the trailing end thereof is bonded to the wound tape portion. For the insertion of the leading end portion of the binder tape in the paper stack, a gap or space for receiving the tape end has to be provided in the paper stack. To this end, a pin-like member has been conventionally employed and forceably inserted into the paper stack through manual operation or in an automatic manner. Thereafter, the tape end portion is inserted into the stack as guided by a thin plate. However, such process is disadvantageous in that the properly stacked paper sheets may be disordered or damaged by the insertion of the thin plate. Further, when the thin guide plate is withdrawn, the inserted tape end may also be undesirably released from the constrained state sandwitched between the stacked paper sheets. Besides, in the hitherto known process, it was impossible or at least difficult to obtain a securely bound bundle of paper sheets, as a result of which some paper sheets may accidentally easily drop out of the bundle.

SUMMARY OF THE INVENTION

Accordingly, an object of the invention is to provide a paper stack binding apparatus which is immune to the disadvantages of the hithereto known apparatus such as described above and which is capable of binding a bundle of stacked paper sheets positively and securely so that the bound bundle may not be afterward loosened.

Another object of the invention is to provide a novel and improved binder apparatus which comprises a divider or splitter means capable of easily forming a gap in the paper stack to be bound, to thereby facilitate the insertion of a leading end portion of the binder tape into the paper stack.

Still another object of the invention is to provide an apparatus of the above type which additionally assures a secure binding of the paper stack in a compressed or compacted state so that thereafter the bundle will not become loosened.

In general, the winding of the binder tape around the paper stack is effected after the leading end portion of the binder tape has been securely inserted in the paper stack. When the binder tape is wound around the paper stack in a desired number of turns, the tape is cut and the trailing end portion thereof is bonded to a tape portion wound around the paper stack, to thereby produce a bundle of compactly bound paper stack.

According to the invention, for inserting the leading end portion of the tape into the paper stack, a gap for receiving the tape leading end is formed by a divider or splitter means comprising a reciprocatably movable plate formed with a knife edge which is movable toward the paper stack and which can penetrate into the stack, to thereby form the gap as the paper stack is fed toward a predetermined winding position, at which position the paper stack is supported on a stationary platform having an upper surface formed with an arcuate recess. The paper stack thus located at the predetermined position is then subjected to a pressing force from above by means of a pressing plate having a bulged lower surface complementary to the arcuate recess formed in the platform. In the compressed state, the paper stack is wound by the binder tape. The cut end portion of the tape is bonded to the tape wound around the paper stack.

BRIEF DESCRIPTION OF THE DRAWINGS

The invention will become more readily apparent from the following description of preferred embodiments thereof shown, by way of example only, in the accompanying drawings, in which.

DETAILED DESCRIPTION OF THE PREFERRED EMBODIMENTS

In the first place, the invention will be described with reference to FIG. 1 which shows an exemplary embodiment of the paper bundle binding apparatus constructed in accordance with the teachings of the present invention.

Figure 1:
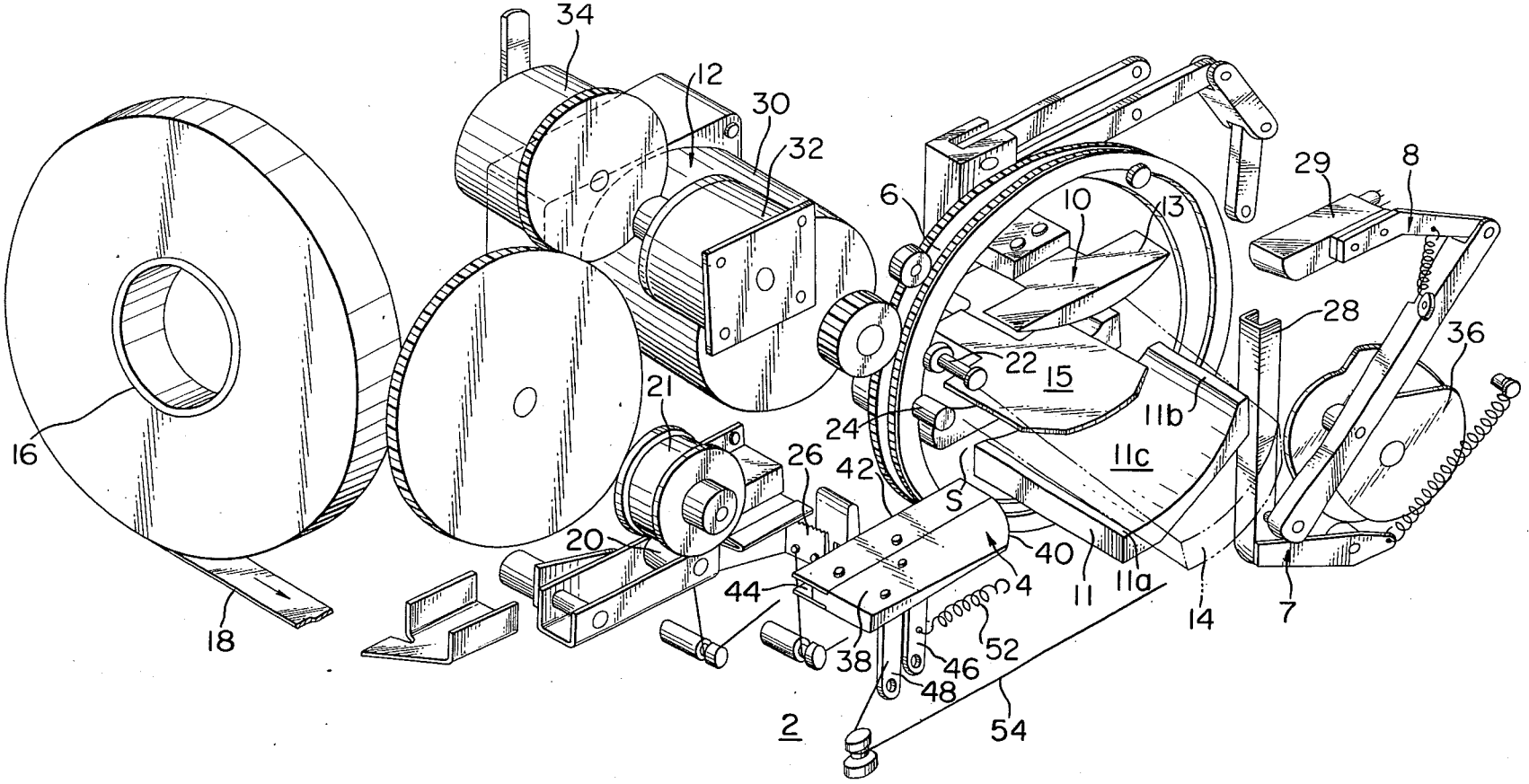
FIG. 1 is a partially exploded perspective view showing schematically a general arrangement of a paper stack binding apparatus constructed in accordance with the teachings of the invention.

Referring to FIG. 1 which shows schematically a general arrangement of a paper bundle or stack binding apparatus for binding a stack of paper sheets such as paper money according to a preferred embodiment of the invention, the binding apparatus generally denoted by reference numeral 2 comprises a divider means 4 for producing a gap in a loaded stack or bundle 14 of papers, such as paper money, for receiving therein the tape leading end, a flier assembly 6 for winding the binder tape or band 18 around the paper sheet bundle, a press unit 7 for pressing together the binder tape 18, a sealing unit or assembly 8 for bonding the pressed portions of the binder tape to the tape portion wound around the paper sheet bundle, a clamping unit 10 for holding the paper stack in a compressed state, a driving unit 12, a tape feeding or dispensing unit 20 and a tape cutting unit 26.

Figure 4:
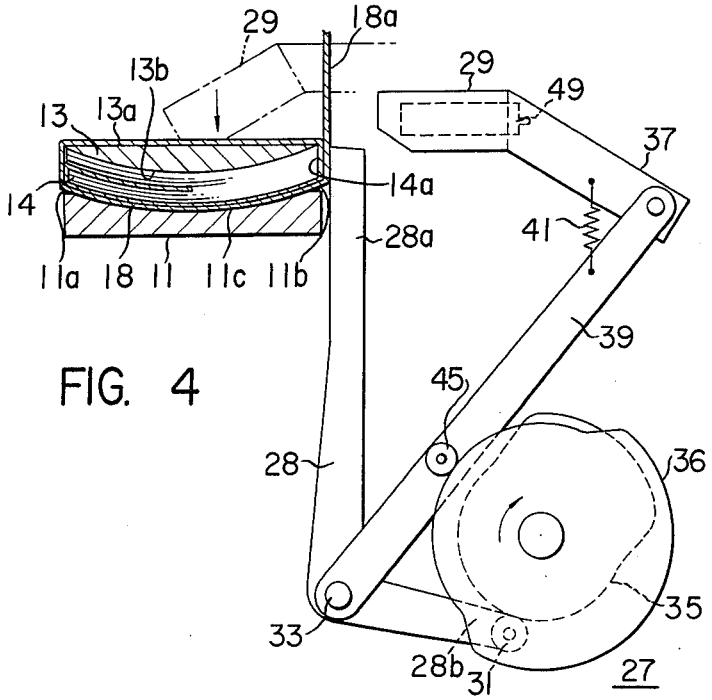
FIG. 4 is an elevational view of a bonding mechanism constituting a part of the apparatus shown in FIG. 1.

When the bundle 14 of stacked paper sheets such as paper money is to be bound with the aid of the binder apparatus 2 shown in FIG. 1, the divider means 4 is first moved from a position shown in solid lines in FIG. 1 to position (shown in FIG. 2) extending into the path along which the paper stack or bundle is charged or fed into the apparatus, as the result of which a splitter member of the divider means is penetrated into the stack of papers, whereby a gap is formed in the paper stack 14, as the latter is fed toward a binding location shown by broken lines in FIG. 1. The binding tape 18, which may be a heat-sensitive binding tape stored as wound around a supply reel 16 in the form of a roll is then drawn or dispensed. The leading end portion of the binder tape or band 18 is fed along a predetermined path by means of pinch rollers 20 and 21 and inserted into the gap or space produced in the stack of papers as described above. When the binder band 18 has thus been properly placed, the bundle of the paper 14 is subjected to a clamping or pressing force through the clamping mechanism 10. In such compressed state, the binder tape 18 is nipped between a pair of pins 22 and 24 of the flier unit 6, which are movable relative to each other, and is wound around the paper stack 14, as shown in FIG. 4, through the integral rotation of the pins 22 and 24. When a predetermined length of the binding tape has been wound around the paper bundle, the cutter means 26 which may be of any suitable conventional type is actuated upwardly to cut the tape 18 while the latter is prevented from becoming loosened by means of a pressing lever 28 which serves to press the tape against a lateral side of the paper stack. Subsequently, the end portions of the tape or band 18 as cut are then bonded together under the action of a bonding pad 29. The paper stack 14 thus having been completely bound is then discharged. The above operations of the binder apparatus are controlled by the driving unit or mechanism 12 comprising a motor 30, braking means 32 and a clutch 34. Further, the timing required in the above outlined operations of the binder apparatus is effected with the aid of a cam assembly 36 which is adapted to be driven by the driving means 12 and which is shown only partially for simplication of the drawing. Although the paper bundle or stack 14 is shown as fed into the binder apparatus in the substantially horizontal position, it will be appreciated that the paper stack 14 may be inserted in a slightly or considerably inclined plane so that the loading of the paper stack 14 may be facilitated. In such case, the associated individual units or mechanisms as described above will be disposed in correspondingly inclined states.

Figure 2:
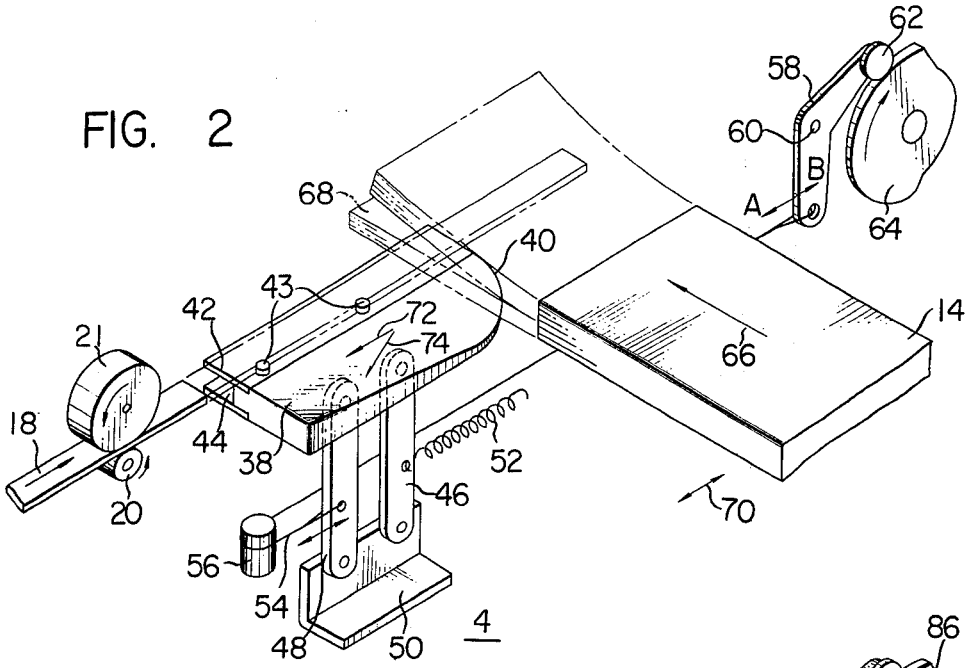
FIG. 2 is a perspective view showing schematically a divider or splitter apparatus according to one embodiment of the invention.

Referring to FIG. 2, there is shown the divider unit or apparatus 4 which is destined to produce a gap in the paper stack 14 for receiving the leading end portion of the binder tape 18, whereafter such leading tape end is secured in the paper stack in a sandwiched state. This apparatus 4 comprises a splitting block 38 in thereform of a substantially flat plate which is formed with an arcuately curved knife edge 40 in that portion or quadrant generally facing the stack and extending toward the path along which the paper stack 14 is fed to the winding position. The thickness of the block plate 38 progressively decreases toward the arcuate knife edge 40. Mounted at the rear side of the splitter or divider plate 38 by suitable means such as screws shown at 43 are a pair of parallel plates 42 and 44, which extend generally perpendicular to the feeding direction 66 of the paper stack 14. A guide path is defined between the plates 42 and 44 for guiding the binder tape 18 toward the paper stack. Disposed under the splitter plate block 38 are a pair of link members 46 and 48 which are swingably connected at upper ends thereof to the splitter plate 38. The lower ends of the link members 46 and 48 are rotatably connected to a supporting block 50. A spring 52 is connected at one end thereof to a stationary frame (not shown), while the other end of the spring 52 is connected to the link member 46 thereby to urge the latter and hence the plate 38 in the direction toward the feeding path of the paper stack 14. The link member 48 is connected to one end of a lever 58 through a wire or cord 54 extending around a pulley 56. The lever 58 is rotatable about a shaft 60 and has the other end portion provided with a cam follower 62 which is adapted to engage with a cam 64 of the cam assembly 36 described above. In dependence upon the rotation of the cam 64, one end portion of the lever 58 is swung in either direction indicated by arrows A or B. When the lower 58 is rotated in the direction B, the splitter plate 38 will be then moved backwardly by the cord 54 against the force of spring 52.

In operation of the above described apparatus for producing the gap in the paper stack 14 by the splitter plate 38, the lever 58 is caused to swing in the direction A by rotating the cam 64 in the corresponding direction, to thereby loosen the cord 54.

In such condition, the splitter or divider plate 38 is caused to move into the path of the paper stack 14 under the influence of the spring 52. At that time, the leading side of the paper stack 14 as fed in the direction 66 will come to contact with the confronting splitter edge 40 and will thereby be divided into two layers of papers. As the paper stack is futher advanced, a gap 68 is produced between the divided layers of the paper stack 14. In order to produce the gap 68 in the stack 14 at a predetermined proper position, it is necessary to maintain any lateral displacement or deviation, in the directions of arrow 70, of the paper stack at a minimum.

When the gap 68 has thus been produced, the binder tape 18 is dispensed from the supply roll through the operated pinch rollers 20 and 21 and inserted into the gap 68 to a position intermediate of the paper width by guiding the tape 18 between the rear plates 42 and 44 of the splitter plate 38. Thereafter, the lever 58 is rotated in the direction B by correspondingly rotating the cam 64. Then, the splitter plate 38 will be moved backwardly in the direction designated by arrow 72 through the link member 48 and the wire 54. The tape end inserting operation has thus been completed and the binder apparatus is in position to commence the paper stack pressing operation and the tape winding operation. In connection with the splitter plate 38, it is to be noted that the backward movement of the splitter plate 38 may be effected in an inclined direction indicated by arrow 74 in place of the direction 72. In such case, the stroke required for the backward movement of the splitter plate is advantageously reduced, whereby succeeding operations can be carried out sooner with a shorter interval being involved.

Figure 3:
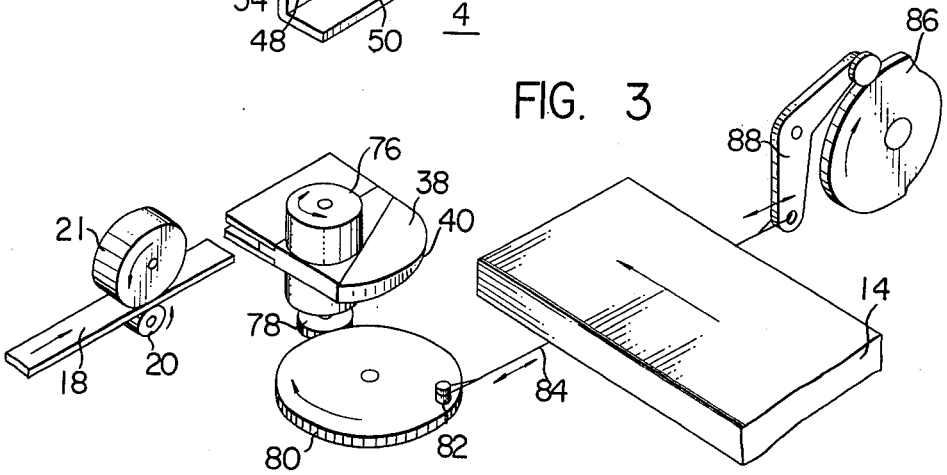
FIG. 3 shows, in a perspective view, another embodiment of the divider or splitter apparatus.

FIG. 3 shows another embodiment of the gap forming divider apparatus, in which the splitting operation of the splitter plate 38 is realized through rotating movements of the plate 38. Referring to FIG. 3, the splitter plate 38 is fixedly secured to a rotatable shaft 76 on which a sun gear 78 is fixedly mounted. The gear 78 meshes with the spur gear 80 which is formed with a projection 82 at the upper side surface thereof. The projection 82 is connected through a cord 84 to a lever 88 which is adapted to be rotated by a cam 86. Rotation of the cam 86 will cause the lever 88 to be moved, involving the rotation of the gear 82, as a result of which the splitter plate 38 is reciprocatably rotated to produce a gap in the paper stack. The splitter plate 38 is of course formed with an arcuate knife edge 40 at such position that the edge 40 may penetrate into the paper stack 14 from the lateral side thereof upon rotation of the splitter or divider plate.

The tape winding apparatus 6 described hereinbefore may be that apparatus disclosed in copending U.S. patent application Ser. No. 791,150, filed by Yukio Ito et al on Apr. 26, 1977 under the title "TAPE WINDING ARRANGEMENT FOR PAPER BUNDLE BINDING APPARATUS" which corresponds to Japanese patent application No. 47210/1976 and has been assigned to the same assignees as the present application. The clamping apparatus 10 described hereinbefore may be that apparatus diclosed in copending U.S. patent application Ser. No. 789,280, filed by Yukio Ito et al on Apr. 20, 1977, entitled "APPARATUS FOR CLAMPING PAPER STACK FOR WINDING THE SAME," which corresponding to Japanese patent application No. 47211/1976 and has been assigned to the same assignees as the present application. For any further information about these apparatus, reference should be made to the above applications.

Referring to FIGS. 1 and 4, the operation of the binding apparatus will be described. The paper stack 14 to be bound by the tape 18 is placed on a receiving platform 11 which is composed of two portions disposed in alignment with each other with a gap of width S interposed therebetween. It will be noted that an arcuate recess 11*c* is formed longitudinally in the upper surface of the platform 11 along with flat edge portions 11*a* and 11*b*. The pressing pad 13 is lowered to bear on the top of the paper stack 14. The pad 13 is formed with a flat top surface 13*a* and a lower arcuately bulged surface 13*b* corresponding to the profile of the arcuate recess 11*a* formed in the platform 11. Thus, when the pressing pad 13 is forced downwardly to press against the paper stack 14, the latter is bent arcuately under the cooperating actions of the bulged lower surface 13*b* of the pressing pad 13 and the arcuate recess 11*a* formed in the platform 11. When the paper stack 14 has thus been compressed in the bent state, the binding tape 18 is wound around the paper stack 14 together with the pressing pad 13 through the rotation of the tape winding flier apparatus 6. Since the through-space S is formed in the platform 11, the winding tape 18 can pass through the space S without being wound on the platform 11. In order to support the lower portion of the paper stack exposed through the gap space S, it is preferred that a resilient flexible plate 15 is disposed on the platform 11 so as to cover the space S. When the binding tape 18 has been wound in a desired number of turns, the tape 18 is cut by the cutting means 26. The trailing end portion 18*a* of the binding tape 18 is then folded upwardly and pressed against a lateral side of the paper stack 14 by the pressing lever 28 (FIG. 1). Next, the upstanding trailing end portion 18*a* of the tape is folded onto the top surface of the paper stack 14 by means of a bonding pad 29 which is so moved as to transversely slide over the flat surface 13*a* of the pressing pad 13. By virtue of such operation of the bonding pad 29, the trailing tape end portion 18*a* is bonded to the wound tape portion. In this connection, it is preferred that a pressure in the downward direction be exerted to the bonding pad 29 while it slides transversely over the upper flat surface of the pressing pad 13 at a relatively low speed, to thereby assure a positive bonding. In case the binding tape is of a heat-sensitive bonding type, the bonding pad 29 should be heated. When the tape 18 has been bonded together, the bound paper stack bundle 14 can be withdrawn from the pressing pad 13 and the resilient supporting plate 15.

In the binding operation described above, since the tape trailing end portion is positively and sharply bent at a corner of the paper stack 14, no relaxation will occur in the wound tape. Further, because the tape bonding operation is effected on the upper surface 13*a* of the rigid pressing pad 13, a secure and positive bonding can be accomplished. When the bound paper stack 14 is withdrawn from the pad 13 at the final stage, the stack is released from the constraint exerted by the bulged surface of the pad 13 and tends to be restored the original flat state. This tendency will increase the tension applied to the wound tape, resulting in a fixedly bound bundle of paper sheets.

Next, a detailed description will be made of the bonding mechanism outlined above.

Referring to FIGS. 1 and 4, the bonding apparatus denoted generally by reference numeral 27 in FIG. 4 comprises a L-shaped pressing lever 28 which has one end 28*a* located adjacent to the lateral side 14*a* of the paper stack 14 and the other end 28*b* provided with a cam follower 31. The lever 28 is mounted rotatably about a shaft 33. The cam follower 31 is adapted to engage with a cam 35. In this manner, the one end 28*a* of the pressing lever 28 can be swung toward and away from the lateral side 14*a* of the paper stack 14 in dependence upon the rotation of the cam 35. The bonding pad 29 which also constitutes a main part of the bonding apparatus 27 in fixedly secured to an arm 37 which is pivotally connected to a lever 39. A spring 41 is connected between the arm 37 and the lever 39 and resiliently urges the arm 37 toward the lever 39. The lever 39 is mounted rotatably on the shaft 33 and has a cam follower 45 at a substantially mid portion thereof. The cam follower 45 is engaged with the cam 36. It should be mentioned that the bonding pad 29 may incorporate therein a heating device 49 and a temperature regulator means (not shown) in order to maintain the bonding pad 29 at a constant temperature.

In operation, when the binding tape 18 has been wound in a predetermined number of turns, the tape 18 is cut and then the free end of portion 18*a* of the binding tape 18 is pressed against the lateral side 14*a* of the paper stack 14 by means of the pressing lever end 28*a* under the contral of the cam 35, whereby the tape end portion 18*a* is sandwitched between the lateral side 14*a* of the paper stack 14 and the pressing lever end 28*a* and is caused to extend vertically upwardly.

Thereafter, the bonding pad 29 is displaced onto the top surface of the pressing pad 13. The bonding pad 29 will operate to press the tailing end portion 18*a* of the tape 18 onto the top flat surface of the pressing pad 13 under the influence of the tension spring 41. The tape which may be of the heat-sensitive bonding type can thus be heated and bonded together. In order to attain a better bonding, the pad 29 may be moved over the pressing pad 13 at a relatively lower speed.

This can be accomplished by correspondingly selecting the contour of the cam 36.

In the above described arrangement of the tape bonding apparatus, a proper timing can be assured in the bonding operations by using two cams mounted on a common shaft. The bonding operation can thus be rapidly accomplished in a completely automatic manner with an improved accuracy.

The paper stack as bundled in the above described manner can be bound in a tensioned state without incurring any relaxation in the wound binder tape.

Although preferred embodiments of the invention have been described, many variations and modifications will readily occur to those skilled in the art without departing from the scope and spirit of the invention defined in the appended claims.

What we claim is:

1. An apparatus for use in a machine for binding a stack of paper sheets moved thereinto, said apparatus comprising:

means for supporting a stack of paper sheets to be bound at a predetermined position, said supporting means comprising first and second fixedly positioned immovable supporting members spaced by a gap, said stack of paper sheets moving in a direction extending substantially transverse of said gap to said predetermined position on said supporting members;

splitter means for splitting a stack of paper sheets into two layers as the stack is moved by said moving means into said predetermined position, said splitter means comprising a reciprocably movable member having a peripheral portion in the form of a knife edge, said movable member being movable between a first position whereat said knife edge is located in the path of a stack of paper sheets during movement thereof to said predetermined position such that said knife edge penetrates into the stack of paper sheets to split the stack into two layers, and a second position whereat said knife edge is spaced from said path;

guide means, integral with said movable member, for guiding a leading end portion of a binder tape to a position between the two layers of paper sheets when said movable member is in said first position thereof, said guide means comprising a pair of parallel plates attached to said movable member;

means for clamping the two layers of paper sheets together, with said leading end portion of a binder tape pressed therebetween, against said supporting means; and means for winding said binder tape around the thus clamped stack of paper sheets.

2. An apparatus as claimed in claim 1, wherein said movable member comprises a plate having a thickness which progressively decreases toward said knife edge.

3. An apparatus as claimed in claim 1, wherein said knife edge has an arcuate configuration.

4. An apparatus as claimed in claim 1, wherein said splitter means further comprises a supporting block, a plurality of parallel link members having first ends pivotally connected to said supporting block and second ends pivotally connected to said movable member, spring means operatively connected to said link members for urging said link members and thereby said movable member in a first direction, and cam means operatively connected to said link members for moving said link members and thereby said movable member in a second direction against the urging force of said spring means.

5. An apparatus as claimed in claim 1, wherein said splitter means further comprises a shaft having said movable member fixed thereto, and cam means operatively associated with said shaft for reciprocably rotating said shaft and thereby moving said movable member between said first and second positions thereof.

* * * * *